US006793686B2

(12) United States Patent
Cimecioglu et al.

(10) Patent No.: US 6,793,686 B2
(45) Date of Patent: Sep. 21, 2004

(54) FINISHING PROCESS FOR CELLULOSIC TEXTILES AND THE PRODUCTS MADE THEREFROM

(75) Inventors: A. Levent Cimecioglu, Princeton, NJ (US); Klein A. Rodrigues, Signal Mountain, TN (US)

(73) Assignee: National Starch and Chemical Investment Holding Corporation, New Castle, DE (US)

( * ) Notice: Subject to any disclaimer, the term of this patent is extended or adjusted under 35 U.S.C. 154(b) by 108 days.

(21) Appl. No.: 10/053,024

(22) Filed: Jan. 18, 2002

(65) Prior Publication Data

US 2003/0145390 A1 Aug. 7, 2003

(51) Int. Cl.[7] ..... D06M 11/30; D06M 13/322

(52) U.S. Cl. ..... 8/189; 8/116.1; 8/181; 536/56

(58) Field of Search ..... 8/116.1, 181, 189; 536/56

(56) References Cited

U.S. PATENT DOCUMENTS 4,277,243 A * 7/1981 Rowland
5,540,876 A 7/1996 Larson et al. ..... 264/479
6,228,126 B1 5/2001 Cimecioglu et al. ..... 8/108.1
6,368,456 B1 4/2002 Cimecioglu et al. ..... 162/146
6,409,881 B1 * 6/2002 Jascinski

FOREIGN PATENT DOCUMENTS

WO WO 99/23117 * 5/1999

OTHER PUBLICATIONS

Tersoro and Williard, Cellulose and Cellulose Derivatives, Bikales and Segal, eds., Part V, Wiley–Interscience, New York, (1971), pp. 835–875.

Kirk–Othmer, Encyclopedia of Chemical Technology, 4$^{th}$ Ed., vol. 23, p. 883, Wiley–Interscience Publication (1997).

* cited by examiner

*Primary Examiner*—Margaret Einsmann
(74) *Attorney, Agent, or Firm*—David P. LeCroy; Laurelee A. Duncan

(57) ABSTRACT

This invention relates to a finishing process for cellulosic textiles which provides a textile having a desirable combination of inherent durable press properties, improved moisture content and improved wicking properties.

21 Claims, No Drawings

FINISHING PROCESS FOR CELLULOSIC TEXTILES AND THE PRODUCTS MADE THEREFROM

FIELD OF THE INVENTION

This invention relates to a finishing process for cellulosic textiles which provides a textile having a desirable combination of inherent durable press properties, improved moisture content and improved wicking properties.

BACKGROUND OF THE INVENTION

Chemical treatments are typically applied to cellulosic textiles in an effort to impart a number of desirable properties. Durable press properties include wrinkle resistance, permanent creases, shrinkage resistance, smooth drying properties. Other desirable properties include improved fiber integrity resulting in less fabric pilling. Such chemical treatments, or finishing processes are applied to yarns, fabrics, or entire garments made of cotton, rayon, linen, ramie, regenerated wood cellulose, or blends made therefrom with polyester.

One such finishing process consists of applying and reacting a crosslinking agent on the yarn, fabric or garment of interest. These finishing agents, or crosslinking agents, are generally bifunctional compounds that, in the context of cellulose crosslinking, covalently couple a hydroxy group of one cellulose to another hydroxy group on a neighboring cellulose fiber. These types of crosslinked cellulose fibers and various methods of preparation are known. See, for example, Tersoro and Willard, Cellulose and Cellulose Derivatives, Bikales and Segal, eds., Part V, Wiley-Interscience, New York, (1971), pp. 835–875.

The traditional chemical crosslinking process has certain disadvantages. For example, formaldehyde, the least expensive and most effective cross-linking agent for cellulosic textiles, is an irritant and a mutagen in certain bacterial and animal species and is officially classified as a probable human carcinogen. Fabrics treated with formaldehyde or formaldehyde-derived crosslinking agents undesirably tend to release formaldehyde over time. Other types of crosslinking agents have proved unsatisfactory for a number of reasons and often do not provide a satisfactory degree of finishing properties.

In addition, certain conditions under which traditional chemical crosslinking must be conducted are harsh, and counteract some of the desirable effects of the crosslinking treatment. For example, these conditions can reduce the overall integrity of the fibers in treated textiles sometimes resulting in poor mechanical properties such as tear strength. In addition, the ability of the fiber/textile to absorb moisture is decreased. This decreased absorptivity is manifested in a decreased ability to of the textile to absorb and retain dyes.

There are further disadvantages to the manufacturing use of chemical crosslinking finishing treatments. Salts and excess residual chemicals formed during the crosslinking reaction, such as formaldehyde, must be washed out of the textile. Therefore, in addition to environmental problems caused by contaminated wastewater, the chemical crosslinking process ordinarily requires further expensive post-treatment processes in order to ensure that the treated textile is free of dangerous chemicals and irritants.

Accordingly, there is a continuing need to provide a finishing process for cellulosic textiles which provides textiles having a combination of desirable properties and which does not require the use of expensive and hazardous chemical crosslinking agents.

SUMMARY OF THE INVENTION

The present invention provides a finishing process for cellulosic textiles which does not require the use of expensive and hazardous chemical crosslinking agents.

According to the finishing process of the present invention, cellulosic textiles are modified via a nitroxide-mediated oxidation method which imparts controlled quantities of aldehyde and carboxyl functionality to the textile.

Surprisingly, the modified cellulosic textiles finished according to this invention demonstrate a number of desirable properties including a combination of inherent durable press properties and improved moisture content, and wicking properties.

DETAILED DESCRIPTION OF THE INVENTION

According to the finishing process of the present invention, cellulosic textiles are modified via a nitroxide-mediated oxidation method which imparts controlled quantities of aldehyde and carboxyl functionality to the textile. In particular, the primary ("C6") alcohols on the cellulose portion of cellulosic textiles, are selectively oxidized with a suitable oxidant in the presence of a nitroxide radical mediator.

The finishing process of the present invention is related to the nitroxide-mediated processes described in U.S. Pat. No. 6,228,126 and pending U.S. Ser. Nos. 09/454,400, 09/575,303, the disclosures of which are incorporated herein by reference. The finishing process can be conducted in a single-phase aqueous or non-aqueous medium or in a bi-phase medium, in particular in an aqueous medium. The reaction temperature is typically 0 to 50° C. In aqueous media, the absolute amount of aldehyde formed from primary alcohols and the ratio of aldehyde formed to carboxylic acid formed in the oxidation reaction can be controlled by manipulating the reaction conditions including oxidant amounts, reagent and catalyst concentrations, time, temperature, etc.

The reaction conditions and co-catalysts used may be manipulated by one skilled in the art to achieve the desired end product. The modified cellulosic textiles of this invention can be prepared by a method which involves the selective oxidation of cellulosic textile using a limited amount of oxidant and mediated with a nitroxyl radicalunder defined conditions to provide derivatives with effective aldehyde and carboxyl content.

The nitroxyl radical mediator used herein is a di-tertiary alkyl nitroxyl radical having one of the following formulas:

(I)

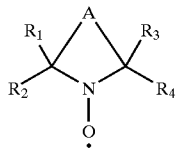

or

-continued (II)

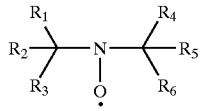

in which A represents a chain (saturated or unsaturated) of particularly two or three atoms, in particular carbon atoms or a combination of one or two carbon atoms with an oxygen or nitrogen atom, and the $R_1$–$R_6$ groups represent the same or different alkyl groups. Chain A may be substituted by one or more groups such as alkyl, alkoxy, aryl, aryloxy, acyloxy, amino, amido or oxo groups, or by a divalent group or multivalent group which is bound to one or more other groups having formula I. Particularly useful nitroxyl radicals are di-tertiary alkyl nitroxyl radicals having the formula:

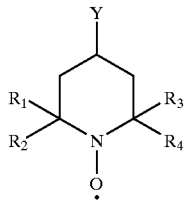

in which Y is either H, OH, OR', NH—C(O)—R', OC(O)R', keto or acetal derivatives, and R' is alkyl or aryl; and each of the $R_1$–$R_4$ groups represent the same or different alkyl groups of 1 to 18 carbon atom and more particularly methyl groups. Nitroxyl radicals of this type include those in which a) the $R_1$–$R_4$ groups are all methyl (or alkyl of 1 carbon atom) and Y is H, i.e., 2,2,6,6-tetramethyl-1-piperdinyloxy (TEMPO); b) $R_1$–$R_4$ groups are methyl and Y is OH and identified as 4-hydroxy TEMPO; and c) $R_1$–$R_4$ groups are methyl and Y is NH—C(O)—$CH_3$ and identified as 4-acetamido TEMPO. In particular, the nitroxyl radical is TEMPO or 4-acetamido TEMPO. The nitroxyl radical is used in an effective amount to mediate the oxidation, particularly in an amount of from about 0.001 to 20% by weight, more particularly from about 0.001 to 0.2% by weight, even more particularly from about 0.005 to 0.02% by weight, based on the weight of cellulose contained in the cellulosic textile. The nitroxyl radical can be added to the reaction mixture or generated in situ from the corresponding hydroxylamine or oxoammonium ion.

The oxidant used in this invention can be any material capable of converting nitroxyl radicals to their corresponding oxoammonium salt. Particularly useful oxidants are the alkali or alkaline-earth metal hypohalite salts such as sodium hypochlorite, lithium hypochlorite, potassium hypochlorite or calcium hypochlorite. An alkali or alkaline earth-metal hypobromite salt may also be used and it may be added in the form of the hypobromite salt itself, such as sodium hypobromite, or it may be formed in situ from the addition of a suitable oxidant such as sodium hypochlorite and an alkali or alkaline-earth metal bromide salt such as sodium bromide. The bromide ion is generally in the form of sodium bromide. Additional oxidants that can be used in this method include hydrogen peroxide in combination with a transition metal catalyst such as methyltrioxorhenium (VII); hydrogen peroxide in combination with an enzyme; oxygen in combination with a transition metal catalyst; oxygen in combination with an enzyme; peroxyacids such as peracetic acid and 3-chloroperoxybenzoic acid; alkali or alkaline-earth metal salts of persulfates such as potassium persulfate and sodium persulfate; alkali or alkaline-earth metal salts of peroxymonosulfates such as potassium peroxymonosulfate; chloramines such as 1,3,5-trichloro-1,3,5-triazine-2,4,6(1H,3H,5H)trione, 1,3-dichloro-1,3,5-triazine-2,4,6(1H,3H,5H)trione sodium salt, 1,3-dichloro-5,5-dimethylhydantoin, 1-bromo-3-chloro-5,5-dimethylhydantoin, and 1-chloro-2,5-pyrrolidinedione; and alkali or alkaline-earth metal salts of ferricyanide. This list of oxidants is only illustrative and is not intended to be exhaustive. The oxidants can be used alone or in combination with an alkali or alkaline-earth metal halide salt, particularly including sodium bromide. A particularly suitable oxidant is sodium hypochlorite or sodium hypobromite formed from the addition of sodium hypochlorite and sodium bromide.

When oxidizing cellulosic textiles, the oxidant is generally used in a limited amount that has the equivalent oxidizing power of up to 10.0 g of active chlorine per 100 g of cellulose contained in the cellulosic textile. The amount of oxidant used may have an equivalent oxidizing power of from about 0.05 to 5.0 g of active chlorine and preferably from about 0.5 to 2.5 g of active chlorine per 100 g of cellulose contained in the cellulosic textile. When sodium hypochlorite is used, it typically is used in a limited amount of up to about 10 percent by weight based on the weight of cellulose contained in the cellulosic textile, more particularly from about 0.1 to 5% and preferably from about 0.1 to 5% by weight based on the weight of cellulosic textile. Bromide in the form of sodium bromide will generally be used in an amount of from about 0.01 to 2.5% by weight and preferably from about 0.05 to 1.0% by weight based on the weight of cellulose contained in the cellulosic textile. By limiting the amount of oxidant under defined aqueous conditions, the modified cellulosic textiles may be selectively prepared at effective aldehyde and carboxyl levels.

A co-catalyst may also be used to increase the rate of the nitroxide mediated oxidation process. Particularly suitable co-catalysts are described in U.S. Ser. No. 09/575,303. The disclosure of which is incorporated herein by reference.

As defined herein, cellulosic textiles are at least partially composed of naturally occurring fibers based on vegetable sources (cellulose) and manufactured fibers based on natural organic polymers (rayon, lyocell, acetates, etc) as described in Kirk-Othmer, ENCYCLOPEDIA OF CHEMICAL TECHNOLOGY, $4^{th}$ Ed., Vol. 23, page 883, Wiley-Interscience Publication (1997). Such textiles include, without limitation, fibers, staple fibers, filaments, threads, yarns or fabrics, particularly yarns and fabrics, and more particularly fabrics. Such cellulosic textiles may be based on cotton, viscose and cuprammonium cellulose (rayon), lyocell, flax (linen), ramie, hemp, jute, regenerated wood cellulose, cellulose acetate (partially acetylated) and any blend thereof. Blends may include, without limit, polyesters, wool polyamides and (poly)acrylics. Examples of such blends are viscose/cotton, viscose/polyester, lyocell/polyester, lyocell/cotton, cotton/acrylic, cotton/polyester, cotton/polyester/acrylic, cotton/polyamide/polyester. Fabrics comprising the cellulosic textile may be woven, non-woven or knitted.

The oxidation reaction is carried out in an aqueous medium. The pH of the reaction is typically about 4.0 to about 11.0, particularly about 7.0 to about 10.5, more particularly, 8.0 to about 10.0. Though a number of buffering agents may be used, sodium bicarbonate is a particularly useful buffer for pH control, preferably used in the range of from about 0.1 to about 5%, and more particularly from about 0.5 to about 2% based on the weight of cellullose contained in the cellulosic textile. The temperature is maintained at from about 5 to 50° C., particularly from about 15 to 30° C. The amount of oxidant used or the reaction time controls the extent of the reaction. Generally the reaction time will be about 1 to 60 minutes, and more particularly about 5 to 30 minutes, most particularly about 5 to 20 minutes.

Modification of the reaction conditions will enable the manipulation of the effective levels of aldehyde and carboxyl group functionality. For example, the reaction time and/or hypohalite reagent concentration may easily be manipulated in order to prepare a cellulosic textile having certain levels of aldehyde and carboxyl group content. These examples should not be taken as limiting in any regard. One of skill in the art will recognize that in addition to reaction time and hypohalite concentration, other reaction conditions may also be varied in order to easily optimize levels of aldehyde and carboxyl group functionality in cellulosic textiles.

Generally, the range of aldehyde functionality generated will be from about 1 to about 20 mmole, and more particularly from about 1 to about 10 mmole/100 g of cellulose contained in the cellulosic textile. Amounts of carboxyl content generated will generally be from about 1 to about 20 mmoles, and more particularly from about 1 to about 10 mmole/100 g of the cellulose contained in the cellulosic textile. The effective level of aldehyde is an important aspect of this invention. The ratio of generated aldehyde to generated carboxyl functionality will be greater than about 0.5, more particularly greater than or equal to 1.0 (ratio based on the mmol functionality/100 g of cellulose contained in the cellulosic textile). It should be noted that this amount of functionality is in addition to what may already be present in cellulosic textile naturally, or by virtue of the type of cellulosic textile used.

Aldehyde functionality generated on the cellulose contained in the cellulosic textiles of this invention, by virtue of their reactivity with hydroxyl groups on neighboring cellulose chains, in effect enable "self-crosslinking" either within (intra-fiber) the cellulose fiber or between neighboring (inter-fiber) cellulose fibers.

The modified cellulosic textiles of the present invention demonstrate desirable durable press characteristics. For example, as compared to untreated fabrics, the improved overall wrinkle recovery or crease resistance of these textiles is demonstrated by the increase in the wrinkle recovery angle of the treated textiles. It is thought that the above-described "self-crosslinking" contributes to the surprising durable press characteristics inherently demonstrated by the cellulosic textiles of this invention. These desirable durable press characteristics include wrinkle resistance, permanent creases, shrinkage resistance, and smooth drying properties. Advantageously, there is no need to resort to the expensive crosslinking reagents currently used in the industry to produce durable press textiles.

The modified cellulosic textiles of the present invention also demonstrate desirable increases in moisture content and "pick-up" as compared to the corresponding untreated fabric under moisture equilibrium conditions. It is thought this is due to the combination of the generation of hydrophilic groups (carboxyl groups) and a relatively low degree of intra-fiber crosslinking. Thus, cellulose textiles treated according to the present invention may be dyed after treatment. In contrast, conventional crosslinking treatments ordinarily adversely affect the moisture content and "pick up" of fabrics thereby requiring dying prior to crosslinking treatment.

It is also anticipated that the "dyeability" (including dye uptake) and dye fixation characteristics of cellulosic textiles of the present invention will be further improved when treated with conventional dyes such as reactive and ionic dyes due to the presence of reactive aldehyde groups and the anionic character of the generated carboxyl groups. Moreover, these textiles may also tolerate a broader range of dyestuffs.

The "self-crosslinked" cellulosic textiles of the present invention also demonstrate increased fiber integrity resulting in a fabric having less tendency to pill or abrade. The integrity of the "self-crosslinked" cellulosic textile is also enhanced as compared to conventionally crosslinked fabrics as there is no need to subject the textiles to the harsh conditions typically used in conventional crosslinking treatments. Almost every known chemical treatment of cellulosic textiles, such as cotton, reduces the strength, abrasion resistance and other desirable qualities. See Encyclopedia of Polymer Science and Engineering, Textile Resins, Vol. 16, pg 700 (1989).

Further, by virtue of the hydrophilic modification of the textile (generation of aldehyde and carboxyl groups), the cellulosic textiles of the present invention are anticipated to demonstrate antisoiling, deodorizing, antistatic and comfort properties characteristic of fabrics modified by hydrophilic treatments.

In addition to properties normally exhibited by textiles finished by conventional crosslinking techniques, the textiles of the present invention unexpectedly demonstrate a significant degree of wicking as compared to the corresponding unmodified textiles. This is an improvement that is unexpected in the context of known crosslinking finishing processes and may be used to advantage in fabrics, particularly garments, including, for example, sports clothes which require the fast and efficient removal of moisture from the skin. The finishing process of the present invention can be used to improve the properties of a variety of cellulosic fabrics including, for example, garments, industrial fabrics and outdoor fabrics.

The reactive aldehyde and carboxyl groups produced according to the present invention may also be further derivatized to provide an enhanced finish. In such a finish at least part of the aldehyde groups may be derivatized with compounds or polymers containing aldehyde reactive functional groups including, without limitation, hydroxyl, thiol, amino, amido and imido groups. Similarly, at least a part of the carboxyl groups may be derivatized by compounds containing carboxyl reactive functional groups including, without limitation, hydroxyl and amino groups.

Enhanced finishes achieved by further modification of the aldehyde and carboxyl groups may confer improved or new properties upon the treated cellulosic textile including permanent press, softening, soil release, water repellancy and flame retardancy.

The following examples will more fully illustrate the embodiments of this invention. In the examples, all parts and percentages are by weight and all temperatures in degrees Celsius unless otherwise noted. Also, when referring to the cellulose contained in the cellulosic textile, it includes equilibrium moisture content.

EXAMPLES

Example 1

This example illustrates the preparation of the modified cellulosic textiles of the present invention.

Cotton swatches (12"×12", TIC-400, cotton print cloth, desized & bleached, available from Textile Innovations Corp., North Carolina, USA) were prewashed three times to remove any mill finishes. They were then treated in the following manner. 4-Acetamido-TEMPO (4-AT, 6 mg), sodium bromide (0.6 g) and sodium bicarbonate (0.6 g) were added to a suspension of the cotton swatches (30 g) in ca. 1 It water in glass bottles. Sodium hypochlorite (6.6 g as 9.1% solution) was introduced all at once and the bottles were immediately sealed. They were then vigorously agitated on a shaker for a prescribed period of time at room temperature. At the end of the treatment period, the reactions were terminated using ascorbic acid (ca. 1 g) to scavenge the residual chlorine.

The swatches were filtered, washed extensively with water at pH 4-5 and dried in air at room temperature.

Aldehyde content of modified swatches was determined by titration of the hydrochloric acid generated during oxime derivatization with hydroxylamine hydrochloride according to the following scheme and procedure.

$$RCHO+NH_2OHHCl \rightarrow RCHNOH+HCl$$

A suspension of a modified swatch (cut into small pieces) in water (ca. 200 mL) was adjusted to pH 4 with aqueous HCl and allowed to stabilize at this pH. Separately, the pH of a freshly prepared 2 M aqueous solution of hydroxylamine hydrochloride was also adjusted to 4 with HCl. An aliquot of this solution (ca. 3 mL) was then rapidly introduced to vigorously stirred suspension. The pH of the mixture was maintained at 4 by titration of HCl formed with a 0.1 N NaOH solution using a Brinkmann pH STAT 718 Titrino. The titration was continued until no further reduction in pH of the mixture could be detected (ca. 1 h). Aldehyde level was calculated based on the total consumption of NaOH using the following equation.

$$\text{mmole/100 g —CHO} = \frac{\text{mL of NaOH titrant} \times \text{N of NaOH} \times 100}{\text{g swatch weight}}$$

The total carboxyl content of the treated swatches were determined according to TAPPI 237 procedure for the determination of carboxyl content.

Treatment times and the properties of the modified swatches are listed in Table 1.

TABLE 1

Aldehyde and carboxyl content of modified cotton swatches

| Swatch | Treatment Time (min) | Aldehyde Content (mmole/100 g) | Carboxyl Content (mmole/100 g) |
|---|---|---|---|
| Untreated | — | — | 1.6 |
| Treated | 5 | 2.2 | 2.4 |
| Treated | 10 | 3.9 | 4.4 |
| Treated | 20 | 7.2 | 6.6 |

Example 2

This example illustrates another set of preparation conditions for the modification of cotton textiles.

Cotton swatches (5"×5") were prewashed three times to remove any mill finishes. They were then treated in the following manner. 4-Acetamido-TEMPO (4-AT, 0.5 mg), sodium bromide (12.5 mg) and sodium bicarbonate (50 mg) were added to a suspension of the cotton swatches (5 g) in ca. 100 mL water in glass bottles. Various amounts of sodium hypochlorite (as 9.1% solution) were then introduced each bottle at once and the bottles were immediately sealed. They were then vigorously agitated on a shaker for 30 min at room temperature. At the end of the treatment period, the reactions were terminated using ascorbic acid (ca. 1 g) to scavenge the residual chlorine.

The swatches were filtered, washed extensively with water at pH 4-5 and dried in air at room temperature.

The aldehyde and carboxyl content of treated swatches were determined according to the technique described in Example 1 and are listed in Table 2

TABLE 2

Aldehyde and carboxyl content of modified cotton swatches prepared as described in Example 2.

| Swatch | NaOCl (owf)* | Aldehyde Content (mmole/100 g) | Carboxyl Content (mmole/100 g) |
|---|---|---|---|
| Untreated | — | — | 1.6 |
| Treated | 0.5 | 3.4 | 3.4 |
| Treated | 1.0 | 5.3 | 5.7 |
| Treated | 1.5 | 6.4 | 5.4 |

*owf = on weight of fabric

Example 3

This example illustrates the treatment of polyester/cotton blend textiles.

Polyester/cotton swatches (3"×5", STC EMPA 2/3 polyester/cotton, 65/35, bleached without optical brightener, available from Test Fabrics Inc., Pennsylvania, USA) were prewashed three times to remove any mill finishes and treated in the following manner. 4-Acetamido-TEMPO (4-AT, 1.6 mg), sodium bromide (0.16 g) and sodium bicarbonate (0.16 g) were added to a suspension of the cotton swatches (8 g) in ca. 250 mL water in glass bottles. Sodium hypochlorite (1.76 g as 9.1% solution) was introduced all at once and the bottles were immediately sealed. They were then vigorously agitated on a shaker for a prescribed period of time at room temperature. At the end of the treatment period, the reactions were terminated using ascorbic acid (ca. 1 g) to scavenge the residual chlorine.

The swatches were filtered, washed extensively with water at pH 4–5 and dried in air at room temperature.

The aldehyde and carboxyl content of treated swatches were determined as described in Example 1 and are listed in Table 3.

TABLE 3

Aldehyde and carboxyl content of modified polyester/cotton blend swatches prepared as described in Example 3.

| Swatch | Treatment Time (min) | Aldehyde Content* (mmole/100 g swatch) | Carboxyl Content* (mmole/100 g swatch) |
|---|---|---|---|
| Untreated | — | — | 0.4 |
| Treated | 5 | 0.5 | 0.6 |
| Treated | 20 | 2.1 | 2.6 |
| Treated | 40 | 3.0 | 4.5 |

Example 4

This example illustrates the improved wrinkle or crease resistance demonstrated by the modified cellulosic textiles of the present invention.

Cotton and polyester/cotton blend swatches were treated by similar procedures to those described in Examples 1–3. Wrinkle (crease) recovery angle of the treated textiles were then determined according to AATCC Test Method 66-1998. The results are listed in Table 4.

TABLE 4

Wrinkle (crease) recovery angle tests on treated cellulosic textiles.

| Swatch | Aldehyde Content (mmole/100 g swatch | Carboxyl Content (mmole/100 g swatch) | Wrinkle Recovery Angle (°) |
|---|---|---|---|
| Cotton: | | | |
| Untreated | — | 1.6 | 75 |
| Cotton: | | | |
| Treated | 8.5 | 7.0 | 95 |
| Polyester/Cotton: | | | |
| Untreated | — | 0.4 | 107 |
| Polyester/Cotton: | | | |
| Treated | 2.8 | 5.1 | 131 |

Improved wrinkle recovery or the crease resistance is clearly demonstrated by the increased wrinkle recovery angles exhibited by the treated cellulosic textiles of the present invention.

Example 5

This example illustrates the improved wicking properties of the modified cellulosic textiles of the present invention.

Several cotton swatches were treated by a procedure similar to that described in Example 1 and tested for their moisture wicking properties in the following manner. The swatches were cut into 3×15 cm strips. A line was drawn across the width and 1.5 cm from the bottom of each strip. They were then suspended to the line in a 1000 ppm solution of Direct Red 75 dye for a period of 1 min. Following removal from the solution, strips were hung vertically and allowed to wick the dye solution for an additional 3 min. The wicking distance is expressed as the distance that the dye has traveled from the line on the strips. Measurements were carried out in duplicate for each strip and the average value was taken as the wicking distance which are given in Table 5.

TABLE 5

Wicking properties treated cotton swatches.

| Sample Swatch | Aldehyde Content (mmole/100 g) | Carboxyl Content (mmole/100 g) | Wicking Distance (cm) |
|---|---|---|---|
| Untreated | — | 1.6 | 3.4 |
| Treated | 2.2 | 2.4 | 4.7 |
| Treated | 7.2 | 6.6 | 4.8 |

The improved wicking properties of the modified cotton textiles of the present invention are clearly demonstrated by significant increases obtained in their ability to wick water.

Example 6

This example illustrates the improved moisture content or moisture pick-up properties of the modified cellulosic textiles of the present invention.

Cotton swatches prepared in Example 2 were tested for their moisture content or moisture pick-up at moisture-equilibrium according to Procedure 3 of ASTM D2654 Test Methods. The results are given in Table 6.

TABLE 6

Equilibrium moisture properties of various treated cotton swatches.

| Swatch | Aldehyde Content (mmole/100 g) | Carboxyl Content (mmole/100 g) | Moisture Content (%) | Moisture Pick-up (%) |
|---|---|---|---|---|
| Untreated | — | 1.6 | 7.1 | 7.7 |
| Treated | 3.4 | 3.4 | 8.8 | 9.7 |
| Treated | 6.4 | 5.4 | 9.5 | 10.5 |

Improved moisture retention properties of modified the cotton textiles of the present invention is clearly demonstrated by significant increases exhibited by their moisture contents or moisture pick-ups at moisture equilibrium.

We claim:

1. A finishing process for modifying cellulosic textiles comprising oxidizing the cellulosic textile via a nitroxide-mediated method whereby a controlled quantity of aldehyde and carboxyl functionality in a ratio of greater than about 0.5 based on the moles of each functionality are imparted to the textile.

2. The process of claim 1 wherein the nitroxide-mediated method is conducted in a suitable medium with an oxidant in the presence of an effective amount of a nitroxyl radical mediator.

3. The process of claim 2 wherein the suitable medium is water.

4. The process of claim 2 wherein the nitroxyl radical mediator is a di-tertiary alkyl nitroxyl radical having a formula of (I)

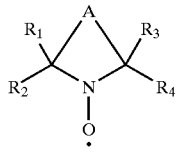

or (II)

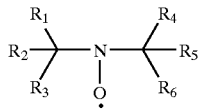

wherein A is a chain having two or three atoms and each atom is selected from the group consisting of carbon, nitrogen, and oxygen; and each $R_1$–$R_6$ group represents the same or different alkyl groups.

5. The process according to claim 4 further comprising at least one co-catalyst.

6. The process of claim 1 wherein the oxidation of the cellulosic textile results in an aldehyde content of from about 1 to about 20 mmole/100 g of cellulose contained in the cellulosic textile.

7. The process according to claim 4 wherein the nitroxyl radical mediator is

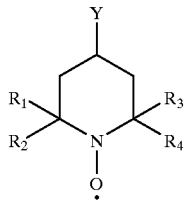

wherein Y is H, OH, OR', NH—C(O)—R', OC(O)R', keto or acetal derivatives and R' is alkyl or aryl; and each of the $R_1$–$R_4$ groups represent the same or different alkyl groups of 1 to 18 carbon atoms.

8. The process of claim 7 wherein the nitroxyl radical mediator is TEMPO or 4-acetamido TEMPO.

9. The process of claim 2 wherein the effective amount of the nitroxyl radical mediator is from about 0.001 to 20% by weight based on the weight of cellulose in the cellulosic textile.

10. The process according to claim 2 wherein the oxidant is an alkali or alkaline-earth metal hypohalite having an oxidizing power of up to 10.0 g active chlorine per 100 g of the cellulose.

11. The process of claim 10 wherein the oxidant is sodium hypochlorite or sodium hypobromite.

12. The process of claim 4 further comprising oxidation of the cellulosic textile in the presence of an alkali or alkaline-earth metal halide.

13. The process of claim 12 wherein the oxidant is from about 0.1 to about 5% sodium hypochlorite; the nitroxyl radical mediator is from about 0.001 to about 0.02% 4-acetamido TEMPO; and the alkali or alkaline-earth metal halide is from about 0.01 to about 2.5% sodium bromide and all percentages being based on the weight of the cellulose in the cellulosic textile.

14. The process of claim 13 further comprising oxidation of the cellulosic textile in the presence of a buffering agent.

15. The process of claim 14 wherein the buffering agent is sodium bicarbonate present in the amount of from about 0.1 to about 5% based on the weight of cellulose contained in the cellulosic textile.

16. The process of claim 1 further comprising modification of the aldehyde functionality with a compound or polymer containing an aldehyde reactive functionality selected from the group consisting of hydroxyl, thiol, amino, amido and imido groups.

17. The process of claim 1 further comprising modification of the carboxyl functionality with a compound containing an carboxyl reactive functionality selected from the group consisting of hydroxyl or amino groups.

18. Modified cellulosic textile finished by the process of claim 1.

19. A modified cellulosic textile having a controlled quantity of aldehyde and carboxyl functionality in a ratio of at least 0.5 based on moles of each functionality, thereby providing a combination of inherent durable press properties, improved moisture content and improved wicking properties compared to a corresponding untreated cellulosic textile.

20. A garment prepared from the cellulosic textile of claim 18.

21. A garment prepared from the cellulosic textile of claim 19.

* * * * *